US007128488B2

(12) United States Patent
Kageyama et al.

(10) Patent No.: US 7,128,488 B2
(45) Date of Patent: Oct. 31, 2006

(54) INSTRUMENT

(75) Inventors: Hidehei Kageyama, Kawagoe (JP); Osamu Torii, Kyoto (JP); Tomoaki Suzuki, Kawagoe (JP)

(73) Assignees: Kotobuki & Co., Ltd., Kawagoe (JP); GSP Institute Co., Ltd., Kyoto (JP)

( * ) Notice: Subject to any disclaimer, the term of this patent is extended or adjusted under 35 U.S.C. 154(b) by 119 days.

(21) Appl. No.: 10/937,293

(22) Filed: Sep. 10, 2004

(65) Prior Publication Data

US 2006/0002756 A1 Jan. 5, 2006

(30) Foreign Application Priority Data

Jul. 5, 2004 (JP) ..... 2004-198579

(51) Int. Cl.
*B43K 24/02* (2006.01)
*B43K 5/16* (2006.01)

(52) U.S. Cl. ..... 401/107; 401/213; 401/108; 401/202; 401/243; 401/248

(58) Field of Classification Search ..... 401/243–248, 401/107, 108, 213, 202
See application file for complete search history.

(56) References Cited

U.S. PATENT DOCUMENTS 1,615,506 A * 1/1927 Felt ..... 401/247
3,992,115 A * 11/1976 Culver ..... 401/106
4,479,732 A * 10/1984 Shimizu ..... 401/213
4,518,273 A * 5/1985 Larizza ..... 401/213
6,866,436 B1 * 3/2005 Kanari et al. ..... 401/108
2006/0027518 A1 * 2/2006 Keda ..... 401/243

FOREIGN PATENT DOCUMENTS

| | | | |
|---|---|---|---|
| GB | 2221872 A | * | 2/1990 |
| JP | 09-99688 | | 4/1997 |
| JP | 2714780 | | 11/1997 |
| WO | WO 82/00614 | * | 3/1982 |

* cited by examiner

*Primary Examiner*—Khoa D. Huynh
(74) *Attorney, Agent, or Firm*—McGinn IP Law Group, PLLC

(57) ABSTRACT

An instrument includes a holder for holding a medium, a cap capable of covering a tip end portion of the medium, and a knock member provided to be capable of knocking to attach and detach the cap. The cap is connected to the knock member via a rotational transform mechanism. The rotational transform mechanism advances the cap in accordance with one knock of the knock member in the axial direction, the rotational transform mechanism rotates the cap around an axis parallel to the axial direction, then retreats the cap, so that the state in which the cap covers the tip end portion of the medium and the state in which the cap allows the tip end portion of the medium to be exposed are switchable for each knock of the knock member.

10 Claims, 14 Drawing Sheets

INSTRUMENT

BACKGROUND OF THE INVENTION

1. Field of the Invention

The present invention relates to an instrument capable of protecting a tip end portion of a writing or applying medium held in a holder by covering the tip end portion with a cap when not in use.

2. Description of the Related Art

Conventionally, in a writing instrument, for example, it is necessary to cover a tip end portion of a writing medium when it is not used in order to protect the tip end portion of the writing medium, to prevent a writing medium from being dried, or not to contaminate surroundings, and to this end, a cap is generally fitted onto a tip end portion of the holder to be attachable and detachable.

However, with the conventional cap, both hands have to be used to remove the cap, its attaching and detaching operation is troublesome, and it is feared that the removed cap is lost.

Therefore, Japanese Patent No. 2714780 proposes a capless writing instrument which can project and retreat a tip end writing portion with a knocking operation without a cap and includes a mechanism for preventing leakage, drying and backflow of ink. In this patent publication, a guide through which a front part of the writing medium can penetrate is provided inside a body of the writing instrument so as to be movable in a longitudinal direction and to restrain the forward movement of a specified amount or more, a seal lid of which inner surface is constituted by an elastic body is provided at a tip end of this guide so as to be openable and closable, and a string-shaped member is connected to the seal lid, so that the string-shaped member pulls the seal lid to closely attach the tip end of the writing medium to the elastic body of the seal lid when the writing medium is housed, and when the writing medium moves forward, pulling of the thread-shaped member is loosened to release the sealed state of the seal lid.

However, in the writing instrument described in the above-described patent, the stroke length advancing the writing medium to project it from the tip end of the body becomes long because it is necessary to provide a space for the seal lid to open and close inside the body.

SUMMARY OF THE INVENTION

In view of the foregoing and other drawbacks, disadvantages and problems of the conventional methods and structures, a first object of the present invention has its object to provide an instrument capable of protecting a tip end portion of a writing or applying medium with an easy operation, and capable of easily switching a state in which the cap covers a tip end portion of the medium and a state in which the cap allows the tip end portion of the medium to be exposed.

In order to attain the above-described object, an instrument according to the present invention includes a holder for holding a medium, a cap capable of covering a tip end portion of the medium, and an operating member provided to be capable of knocking with respect to the holder to attach and detach the cap. The cap is connected to the operating member via a rotational transform mechanism. The rotational transform mechanism advances the cap in accordance with one knock of the operating member in the axial direction, then the rotational transform mechanism rotates the cap around an axis parallel to the axial direction, and then retreats the cap, and with each knock of the operating member, a state in which the cap covers the tip end portion of the medium and a state in which the cap allows the tip end portion of the medium to be exposed are switchable.

When the operating member is knocked in the state in which the cap covers the tip end portion of the medium, the rotational transform mechanism advances the cap, thereafter, rotates the cap around the axis parallel to the axial direction and then, retreats the cap, and therefore the cap is removed from the tip end portion of the medium to be able to establish the state in which the tip end portion of the medium is exposed. On the other hand, when the operating member is knocked in the state in which the cap allows the tip end portion of the medium to be exposed, the rotational transform mechanism advances the cap, thereafter rotates the cap around the axis parallel to the axial direction, then retreats the cap, and therefore making it possible to establish the state in which the cap is attached to the tip end portion of the medium to cover the tip end portion of the medium, preferably the state in which the cap covers the tip end hermetically. By providing the rotational transform mechanism between the operating member and the cap in this manner, movement in the axial direction and rotation of the cap can be reliably performed, and switching is made possible.

The rotational transform mechanism may include a knock cam unrotatable but movable in the axial direction with respect to a slide axial hole provided in the holder, and connected to the operating member, a cam body provided on an inner peripheral surface of the slide axial hole and having a cam surface facing to a front and inclined in an axial direction, a rotary cam connected to the cap and movable in an axial direction with respect to the slide axial hole inside the slide axial hole, and an elastic member for biasing the rotary cam rearward. The knock cam has a cam surface facing to the front and inclined in the axial direction, and rotation of the rotary cam is guided by the cam surfaces of the knock cam and the cam body.

Preferably, the cap can rotate 180 degrees in accordance with one knock operation of the operating member. Thereby, the cap can return to the original position with two knocks.

Preferably, the holder is provided with a hollow portion for housing at least a part of the cap in a state in which the cap allows a tip end portion of the medium to be exposed, at a tip end portion of the holder. With this construction, when the cap is not used in the state in which the tip end portion of the medium is exposed, at least a part of the cap can be housed in the hollow portion to make the outer appearance favorable.

An instrument according to another aspect of the present invention includes a holder for holding a medium, a tip end portion of which is protruded forward from the holder, a slide member provided in the holder to be movable in an axial direction, a cap connected to a tip end portion of the slide member so as to cover a tip end portion of the medium, and an operating portion connected to the slide member and movable in the axial direction so as to be operated from an outside of the holder.

By operating the operating portion by a finger to move it in the axial direction, the cap is moved in the axial direction via the slide member, and the sealed state for protecting the tip end portion of the medium and the seal released state in which the tip end portion of the medium is exposed can be switched. Sealing and seal release of the medium by the cap are mainly performed outside the holder by the operation of the operating portion, and therefore the holder can be constructed to be compact without requiring the stroke of the medium. Since a sealed space can be constructed around the tip end portion of the medium by the cap, it is also possible to keep complete sealing properties.

A hollow portion for housing the cap may be provided in the vicinity of a tip end portion of the holder. In the seal released state, the cap can be housed in the hollow portion provided in the holder, and therefore the cap does not hinder a user from using the medium, and the entire shape of the instrument at the time of using can be made proper one.

An elastic member may be provided for biasing the slide member rearward with respect to the holder. According to this construction, the cap is always biased rearward, and therefore, the cap can reliably seal the tip end portion of the medium in the sealed state, or in the case of that the aforesaid hollow is provided, the cap can be reliably housed in the hollow in the seal released state.

A controller for rotating the slide member and the cap in accordance with the movement in the axial direction of the slide member can be provided between the holder or the medium and the slide member. According to this construction, by only operating the operating portion to advance with fingers, the cap can automatically rotate as well as advance by the controller when the cap advances. As a result that the cap rotates between the position of the same line as the tip end portion of the medium and the position on the line which is not the same as the tip end portion by the controller, the cap can be automatically moved between the sealed state and the seal released state.

The controller can be comprised of a cam surface provided on the holder, and the engaging protruding portion which is provided on the slide member to work in cooperation with the cam surface. With this construction, the controller can be easily produced and reliably operated.

The operating portion can include a side knock member mounted to a side portion of the holder or a rear end knock member mounted to a rear end portion of the holder.

A curved surface portion having a curved outer peripheral surface can be provided on the tip end portion of the medium to keep sealing properties between the tip end portion and the cap. According to this construction, even if the cap is somewhat eccentric relative to the medium when the capper forms sealing, the cap keeps sealing properties to be able to be in close contact with the curved surface portion, and the cap can suitably cover the tip end portion of the medium without directly controlling the cap with fingers.

The present disclosure relates to subject matter contained in Japanese Patent Applications Nos. 2004-198579, filed on Jul. 5, 2004, 2003-3309, filed on Jan. 9, 2003 and, 2003-99049, filed on Apr. 2, 2003 which are expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Figure 1:
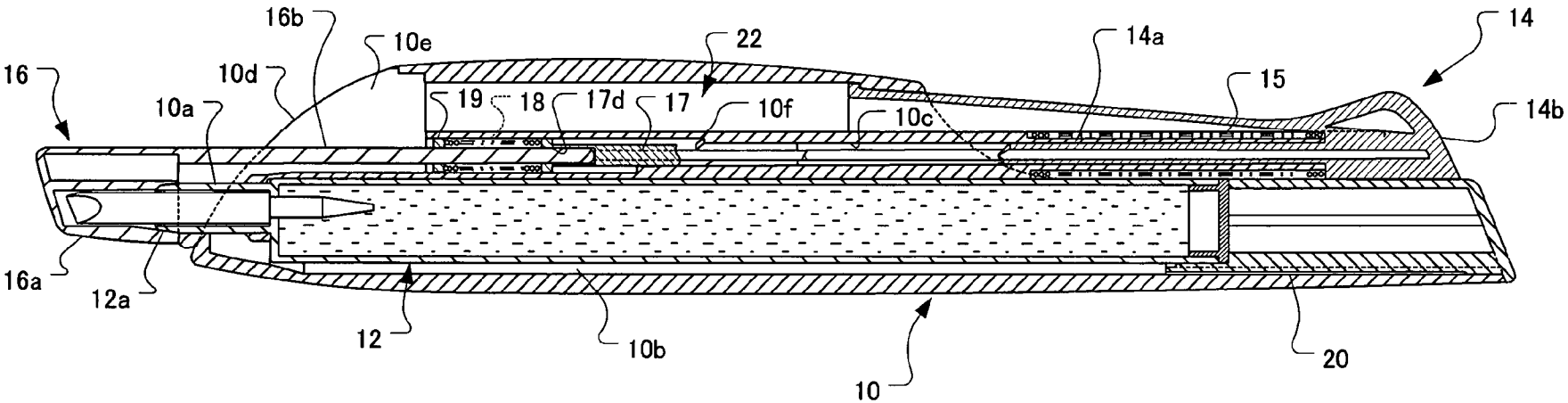
FIG. 1 is an overall longitudinal sectional view of an instrument according to an embodiment of the present invention, and shows a state in which a cap covers a tip end portion of a medium.
Figure 2:
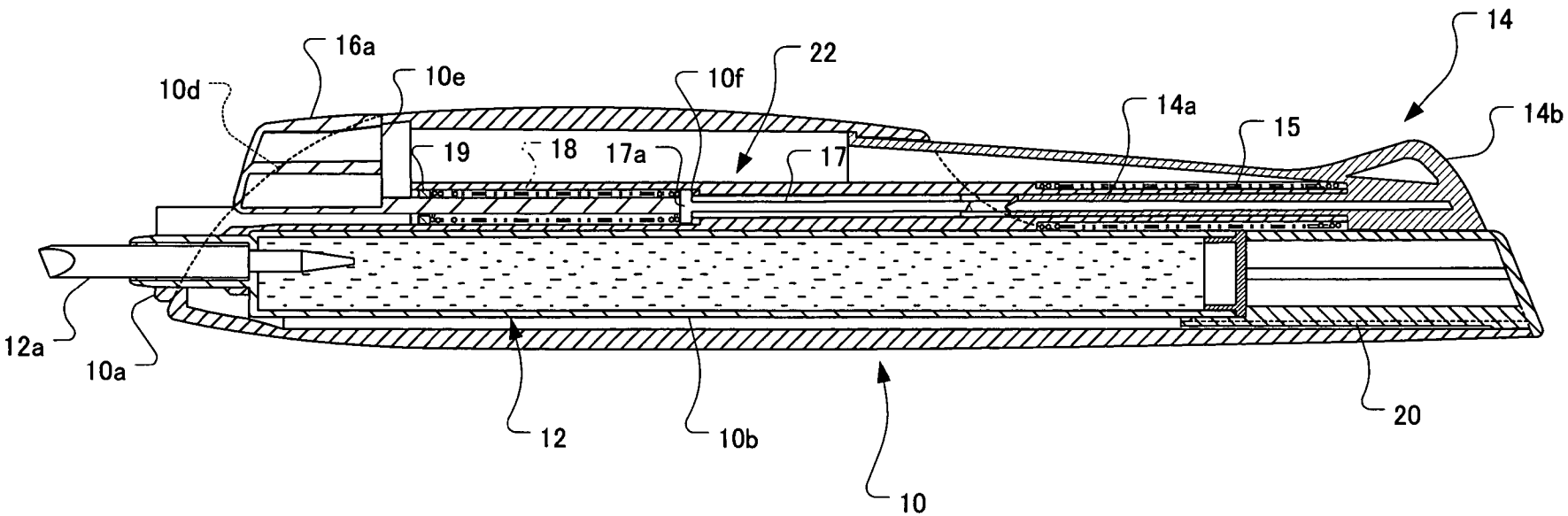
FIG. 2 is an overall longitudinal sectional view of the instrument in FIG. 1, and shows a state in which the cap allows the tip end portion of the medium to be exposed.
Figure 3:
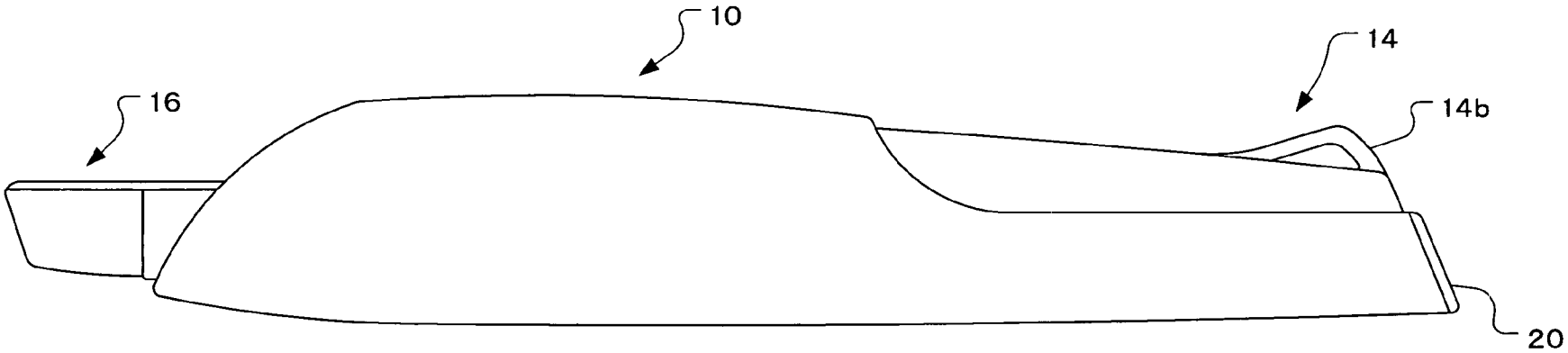
FIG. 3 is an overall view of the instrument in FIG. 1, and shows the state in which the cap covers the tip end portion of the medium.
Figure 4:
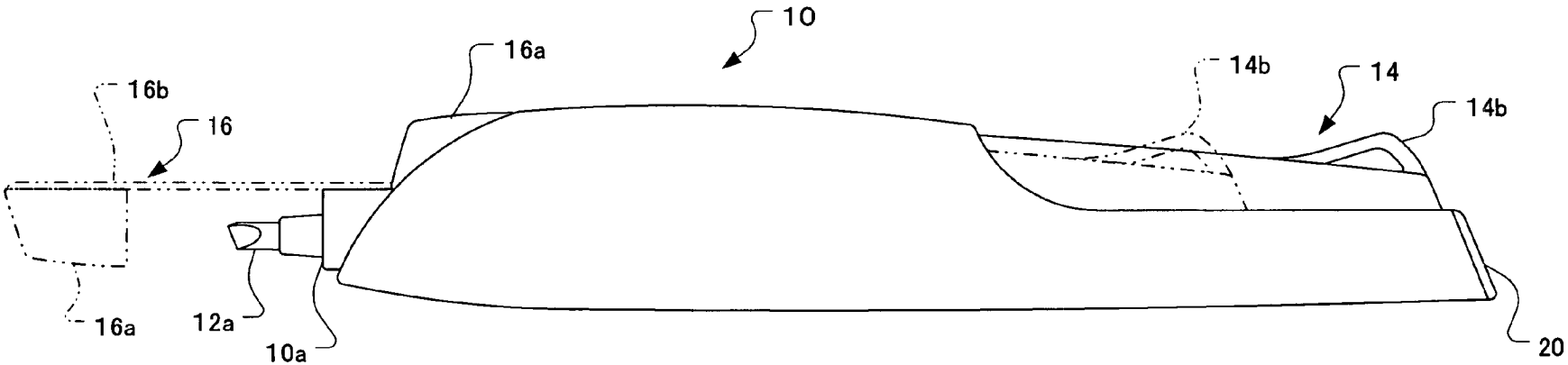
FIG. 4 is an overall view of the instrument in FIG. 1, and shows the state in which the cap allows the tip end portion of the medium to be exposed.

FIG. 1 and FIG. 2 are longitudinal sectional views of a writing instrument according to an embodiment of the present invention, and FIG. 3 and FIG. 4 are overall views of the writing instrument. In the drawings, the writing instrument includes a holder 10 for holding a refill 12 as a writing medium, a cap 16 for protecting a tip end portion 12*a* of the refill 12, and an operating member 14 for performing an attaching and detaching operation of the cap 16.

The refill 12, which is a writing medium, is a separate component from the holder 10 in this example, but the present invention is not limited to this, and the instrument in which the writing medium and the holder are constructed to be an integrated product and a part constructing the writing medium 12 may be practically held by another part constructing the holder 10. In the example shown in the drawings, the holder 10 is constructed by an integrated product, but it may be constructed by a plurality of components.

The refill 12 is a felt pen in this example, but the refill 12 may be writing or applying medium for stationery, cosmetics instrument and the like such as a ball point pen, a fountain pen, an eyeliner, a lip liner, and eye shadow as an instrument 1, and the medium can include the tip end portion 12*a* adapted to the kind of the instrument. For example, when the instrument is a ball point pen, the tip end portion 12*a* includes a ball, and when the instrument is a felt pen, the tip end portion 12*a* includes a felt core.

The holder 10 includes a main axial hole 10*b* in which the refill 12 is housed, and the tip end portion 12*a* of the refill 12 is protruded forward from a front end opening 10*a* of the holder 10.

The holder 10 includes a slide axial hole 10*c* extending in an axial direction in parallel with the main axial hole 10*b* in the inside of the holder 10, and an operating member 14 is placed to be movable in the axial direction inside the slide axial hole 10*c*.

A tip end portion of the operating member 14 is a knock cam 14*a* inserted into the slide axial hole 10*c*, and a rear end portion of the operating member 14 is a knock operation portion 14*b* exposed from the holder 10. It is possible to construct the knock cam 14*a* and the knock operation portion 14*b* by separate components. The knock operation portion 14*b* is movable with respect to the holder 10, and the knock cam 14*a* moves in the axial direction inside the slide axial hole 10*c* by the knock operation. The knock operation portion 14*b* is always biased rearward by a knock spring 15, and is prevented from slipping rearward from the holder 10.

At a tip end portion of the holder 10, a second front end opening 10*d* from which a cap 16 comes in and goes out is formed side by side the front end opening 10*a* from which the tip end portion 12*a* of the refill 12 is protruded, and a hollow portion 10*e* in which a cap body 16*a* of the cap 16 is housed is formed from the second front end opening 10*d* into the holder 10.

The cap 16 has the cap body 16*a* at a tip end portion of the cap 16, and a rod-shaped portion 16*b* extending rearward from the cap body 16*a* to be movable in the axial direction inside the slide axial hole 10*c*. The cap body 16*a* is movable between a position at which the cap body 16*a* covers the tip end portion 12*a* of the refill 12 and the position at which the tip end portion 12*a* of the refill 12 is exposed, and when the cap body 16*a* is at the position where the tip end portion 12*a* is exposed, the cap body 16*a* is housed in the hollow portion 10*e*. It is possible to construct the cap body 16*a* and the rod-shaped portion 16*b* by separate components.

A rear end portion of the rod-shaped portion 16*b* of the cap 16 is inserted into a receiving hole 17*d* formed at a tip end portion of a rotary cam 17 movable in the axial direction inside the slide axial hole 10*c*, and the cap 16 is integrally connected with the rotary cam 17. A return spring 18 is wound around an peripheral surface of the rod-shaped portion 16*b* of the cap 16, and the return spring 18 is interposed between a guide 19 fixed in the slide axial hole 10*c* and a tip end of the rotary cam 17 and always biases the rotary cam 17 and the cap 16 rearward.

A tail tap 20 for closing a rear end of the main axial hole 10*b* is attached to a rear end portion of the holder 10. It is suitable to make the tail tap 20 appropriately detachable so that the refill 12 can be inserted from a rear end of the main axial hole 10*b* in order to replace the refill 12.

The cap 16 and the operating member 14 are connected via a rotational transform mechanism or rotational cam mechanism 22 comprising the rotary cam 17, a cam body 10*f* formed in the slide axial hole 10*c*, the knock cam 14*a* and the return spring 18 which is the elastic member. Hereinafter, the construction of the rotational transform mechanism 22 will be explained.

Figure 5A:
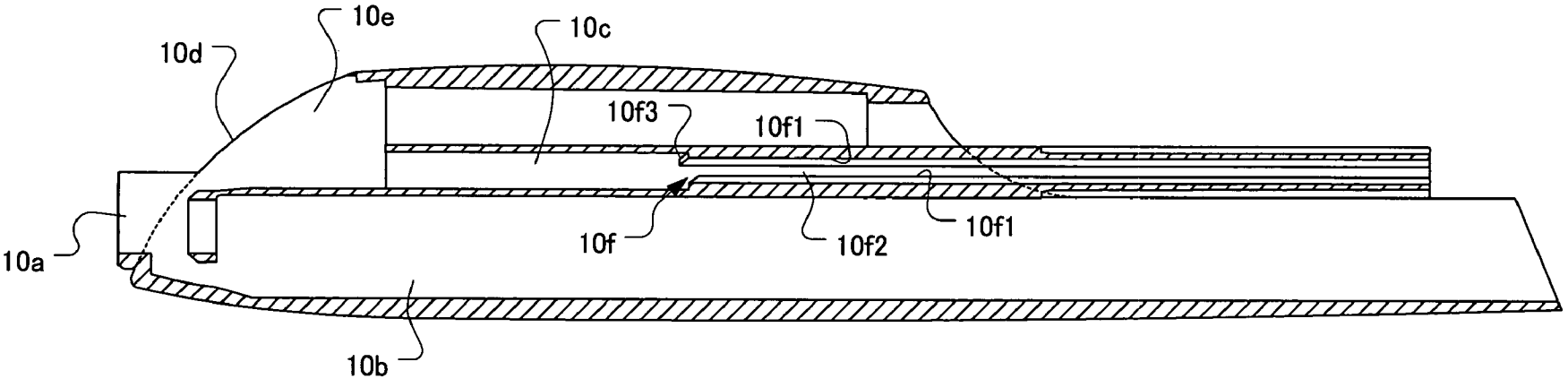
FIG. 5A is a longitudinal sectional view of a holder of the instrument in FIG. 1.
Figure 5B:
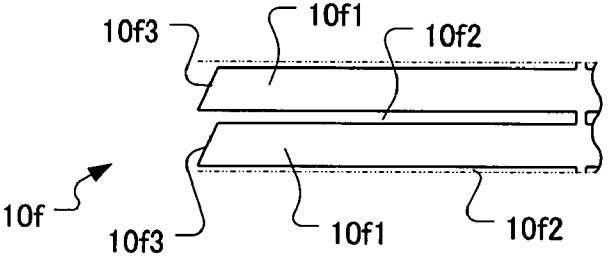
FIG. 5B is a development of a cam body.
Figure 6A:
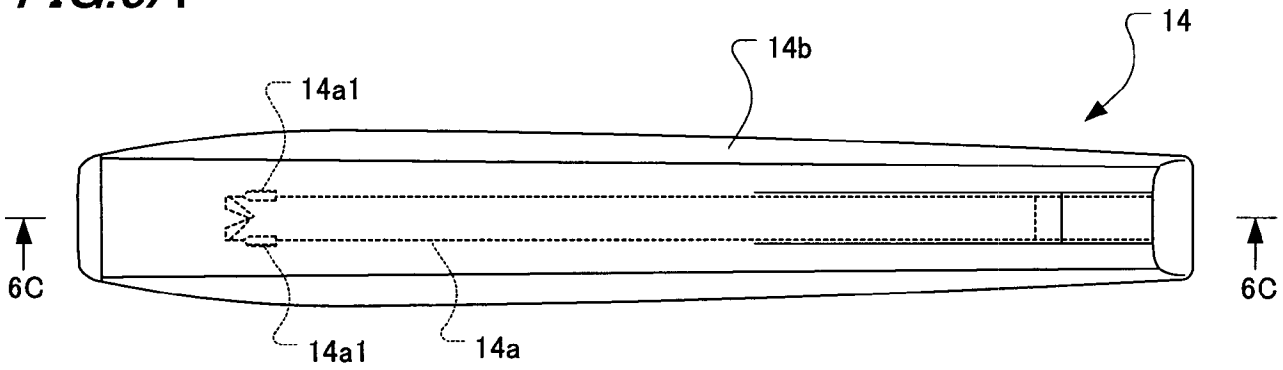
FIG. 6A is a plan view of an operating member of the instrument in FIG. 1.
Figure 6B:
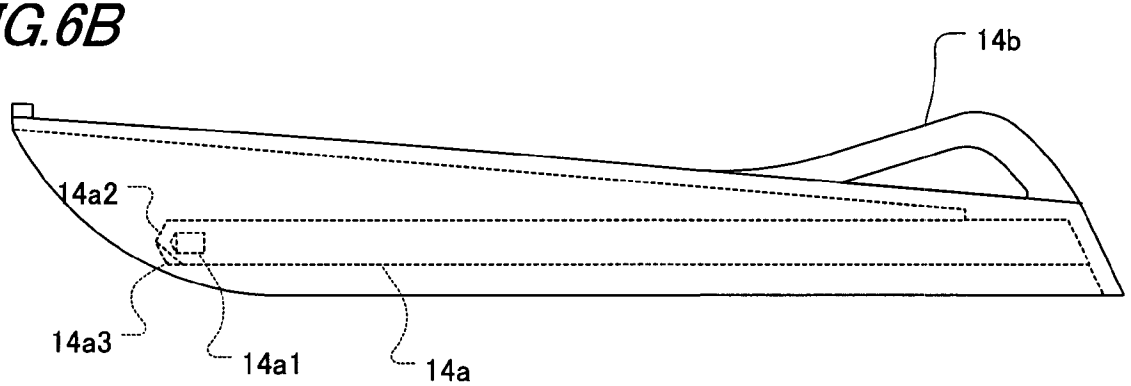
FIG. 6B is a side view.
Figure 6C:
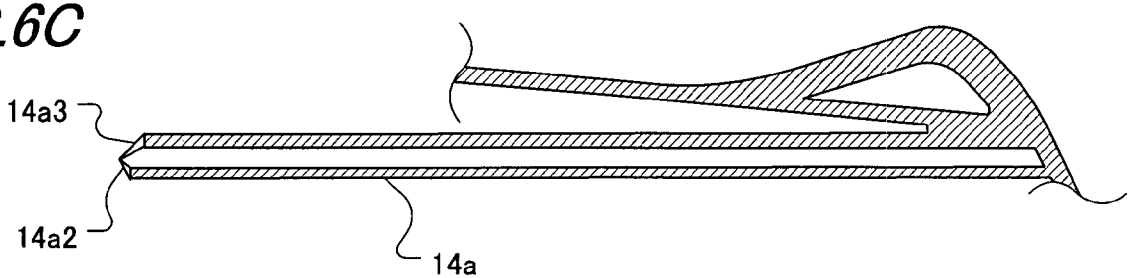
FIG. 6C is a partial sectional view seen along the line 6C—6C in FIG. 6A.

The cam body 10*f* is formed on an inner peripheral surface of the slide axial hole 10*c*. Mountains 10*f*1 and 10*f*1 are formed at every 180 degrees in the cam body 10*f* and longitudinal grooves 10*f*2 and 10*f*2 which correspond to valleys existing between two mountains 10*f*1 and 10*f*1, as shown in a development view in FIG. 5B. Front ends of the mountains 10*f*1 and 10*f*1 become cam surfaces 10*f*3 and 10*f*3 which face forward and are inclined with respect to an axial direction.

Figure 7:
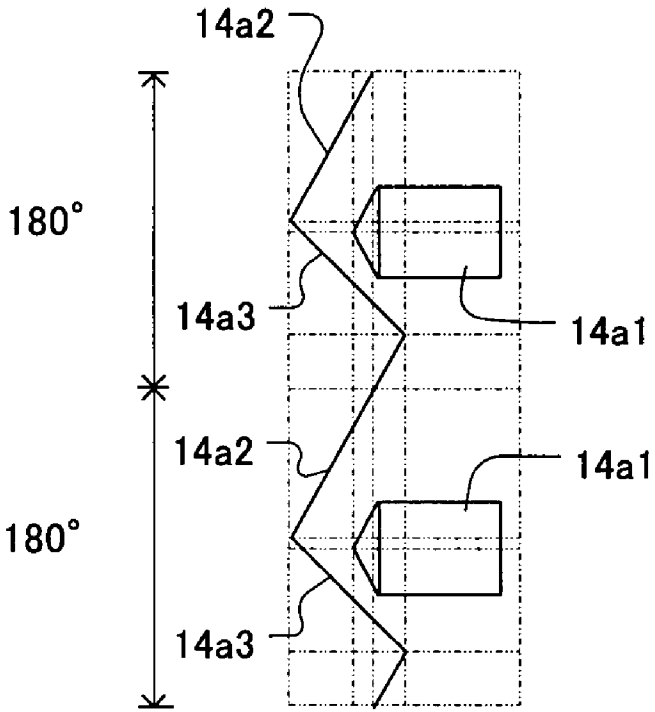
FIG. 7 is a development of the tip end portion of the knock cam of the operating member.
Figure 8A:
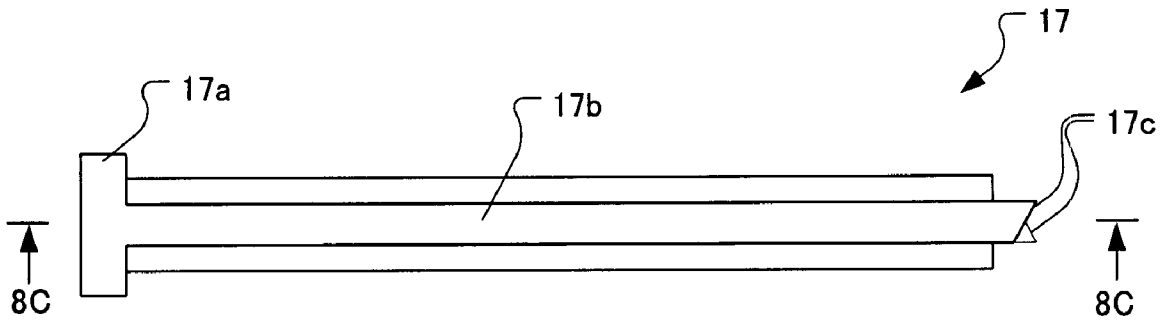
FIG. 8A is a side view of a rotary cam of the instrument in FIG. 1.
Figure 8B:
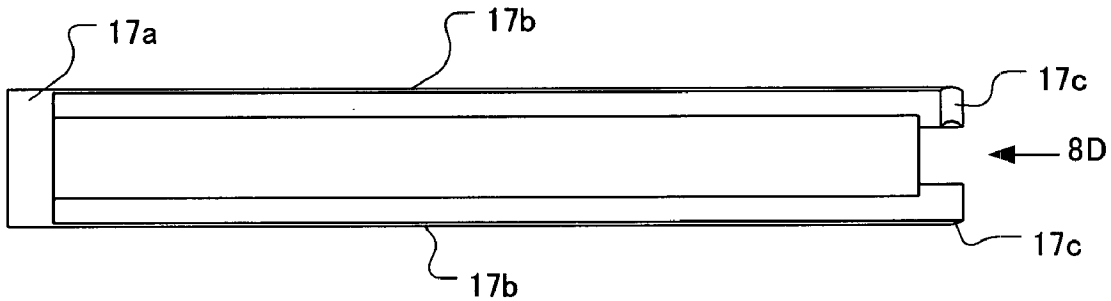
FIG. 8B is a plan view.
Figure 8C:
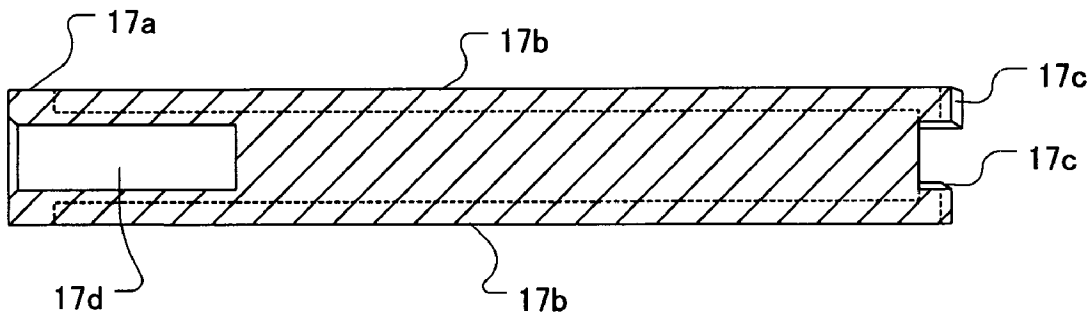
FIG. 8C is a sectional view seen along the line 8C—8C in FIG. 8A.
Figure 8D:
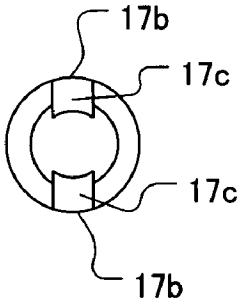
FIG. 8D is a view seen in the arrow D in FIG. 8B.

As shown in a development view in FIG. 7, protrusions 14*a*1 and 14*a*1 are formed at every 180 degrees on an outer peripheral surface of the front end portion of the knock cam 14*a*, and two kinds of cam surfaces 14*a*2 and 14*a*3 inclined with respect to the axial direction are formed at every 180 degrees on a front end surface. The cam surface 14*a*2 is a gentle slope surface and the cam surface 14*a*3 is a steep slope surface, and both of them face to a front and are inclined in the opposite direction from each other. The protrusions 14*a*1 and 14*a*1 are slidably fitted into the longitudinal grooves 10*f*2 and 10*f*2 of the cam body 10*f*, whereby the knock cam 14*a* is unrotatable with respect to the slide axial hole 10*c* and movable in the axial direction.

The rotary cam 17 has a flange portion 17*a* at a front end which is extended in diameter as shown in FIG. 8, and two longitudinal ribs 17*b* and 17*b* formed at an interval of 180 degrees on an outer peripheral surface behind the flange portion 17*a*. The longitudinal ribs 17*b* and 17*b* are slidably fitted into the longitudinal grooves 10*f*2 and 10*f*2 of the cam body 10*f*. Rear end surfaces of the longitudinal ribs 17*b* and 17*b* become cam surfaces 17*c* and 17*c*. The rotary cam 17 is movable in the axial direction with respect to the slide axial hole 10*c*, and is relatively rotatable with respect to the slide axial hole 10*c* when the longitudinal ribs 17*b* and 17*b* get out of the longitudinal grooves 10*f*2 and 10*f*2 of the cam body 10*f* and are located at a front position from the cam body 10*f*.

An operation of the instrument constructed as above will be explained.

When the instrument is not used for writing, the cap body 16*a* of the cap 16 covers the tip end portion 12*a* of the refill 12 to protect the same. When the knock operation portion 14*b* is knocked to perform writing from this state, the knock cam 14*a* advances in the slide axial hole 10*c* and its front end abuts to the rear end portion of the rotary cam 17 to advance the rotary cam 17 (FIG. 9A).

Figures 9A, 9B, 9C:
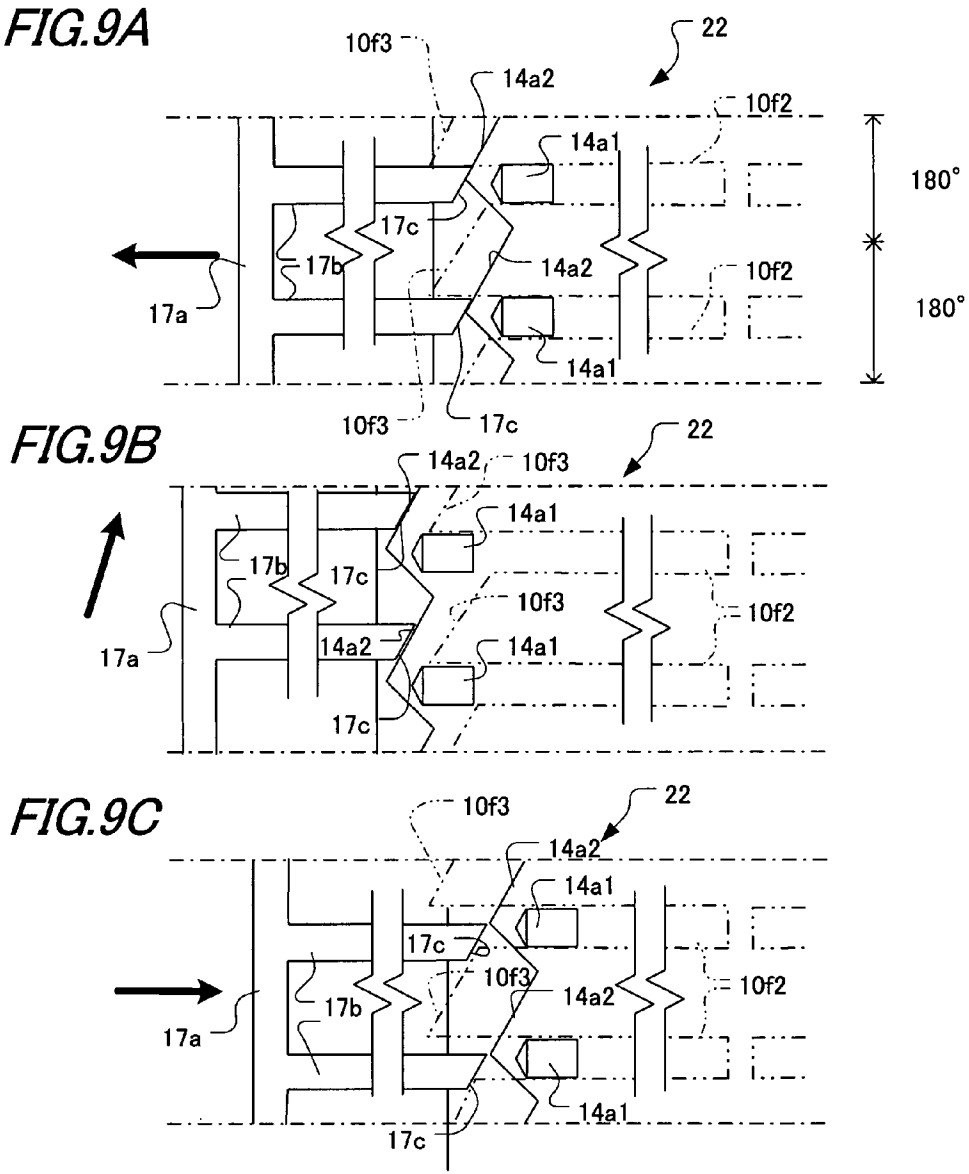
FIGS. 9A to 9C are views showing an operation of a rotational transfer mechanism.

When the longitudinal ribs 17*b*, 17*b* of the rotary cam 17 get out of the longitudinal grooves 10*f*2, 10*f*2 of the cam body 10, the cam surfaces 17*c*, 17*c* of the rotary cam 17 slide along the cam surfaces 14*a*2, 14*a*2 of the knock cam 14*a* with retreat by the biasing force of the return spring 18, and the rotary cam 17 is rotated (FIG. 9B). Further, when the knocking force of the knock operation portion 14*b* is released, the cam surfaces 17*c*, 17*c* slide along the cam grooves 10*f*2, 10*f*2 of the cam body 10*f* (FIG. 9C), and after the rotary cam 17 is rotated 180 degrees, the longitudinal ribs 17*b*, 17*b* are fitted into the longitudinal grooves 10*f*2, 10*f*2, which are different by 180 degrees from the previous grooves 10*f*2 of the cam body 10, and retreat.

With the movement of advance, rotation of 180 degrees, and retreat of the rotary cam 17 as above, the cap 16 also advances, the cap body 16*a* advances further from the tip end portion 12*a* of the refill 12, rotates 180 degrees with the rod-shaped portion 16*b* as the center of rotation, retreats and passes through the front end opening 10*d* to be housed in the hollow portion 10*e*. Thereby, the tip end portion 12*a* of the refill 12 is exposed, and can perform writing.

The retreat position of the cap 16 when the cap 16 allows the tip end portion 12*a* of the refill 12 to be exposed is determined whether the rear end of the cap body 16*a* abuts on the front end opening 10*d* of the holder 10, or whether the flange portion 17*a* of the rotary cam 17 abuts to the mountains 10*f*1 and 10*f*1 of the cam body 10. Since a part of the cap 16 is housed in the hollow portion 10*e*, the cap 16 does not become an obstacle in writing, and favorable appearance can be maintained.

When writing is finished, and the knock operating portion 14*b* is knocked again, the movement of advance, rotation of 180 degrees and retreat of the rotary cam 17 is performed in cooperation of the knock cam 14*a*, the cam body 10*f* and the rotary cam 17 as in the above, and the cap 16 passes through the second front end opening 10*d*, advances from the hollow portion 10*e*, rotates 180 degrees with the rod-shaped portion 16*b* as the center of rotation, retreats and covers the tip end portion 12*a* of the refill 12.

The retreat position of the cap 16 when the cap 16 covers the tip end portion 12*a* of the refill 12 is determined by the cap body 16*a* abutting on the front end opening 10*a* of the holder 10.

As described above, according to this embodiment, the cap 16 can be switched to the state in which the cap 16 covers the tip end portion 12*a* of the refill 12 and the state in which the cap 16 allows the tip end portion 12*a* to be exposed by the rotational transform mechanism 22 every time the knock operation portion 14 is knocked. On switching, the cap 16 rotates every 180 degrees, and the switching operation can be reliably performed.

Figure 10:
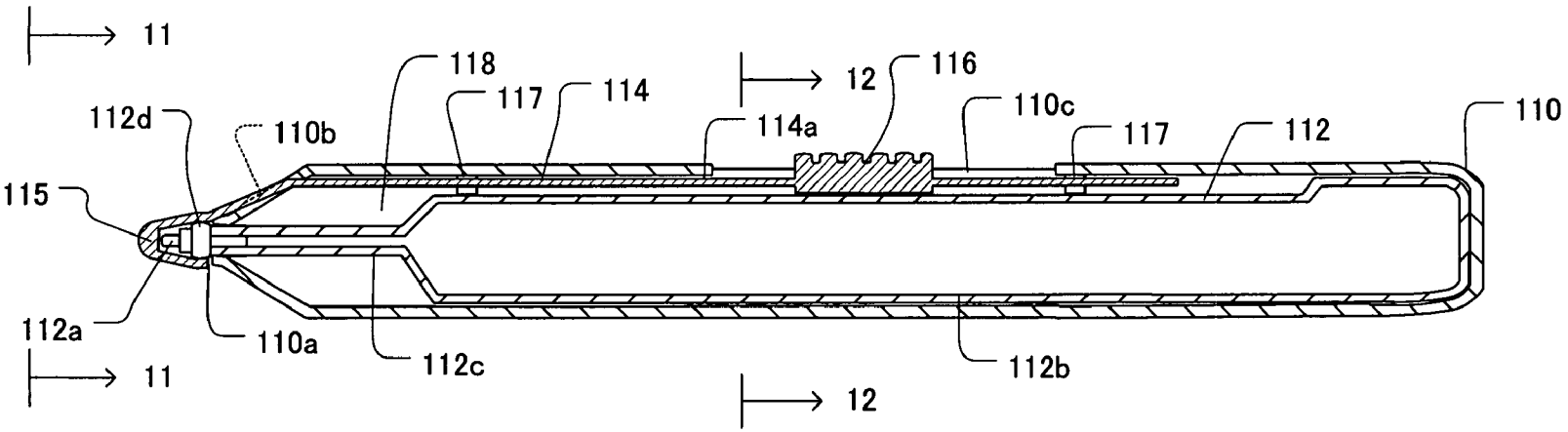
FIG. 10 is a longitudinal sectional view showing an instrument according to a second embodiment of the present invention, and shows a state in which the tip end of the medium is sealed with a cap.

FIG. 10 is a longitudinal sectional view showing an instrument according to a second embodiment of the present invention. In the drawing, a writing medium 112 is housed in a holder 110. The writing medium 112 is fixedly held with respect to the holder 110. In the case of this example, an advancing mechanism for advancing the writing medium 112 does not exist. In the case of this example, the writing medium 112 and the holder 110 are separate components, but the writing medium 112 and the holder 110 are not limited to this, and they may be constructed by an integrated component, in which a part constructing the writing medium 112 is practically held by another part constructing the holder 110. In the example of this drawing, the holder 110 is constructed by an integrated component, but the holder 110 is not limited to this, and it may be constructed by a plurality of components.

As the medium 112, the medium which is the same as the writing medium 12 or applying medium can be used. The tip end portion 112*a* of the writing medium 112 is always protruded forward from a front end opening 110*a* of the holder 110. A rear end portion of the writing medium 112 is a housing portion 112*b* for housing a writing medium such as writing ink, a part between the housing portion 112*b* and the tip end portion 112*a* is a joint part 112*c*. The tip end portion 112*a* and the joint portion 112*c* have reduced diameter smaller than that of the housing portion 112*b*. A curved surface portion 112*d* having a partially spherical-shaped outer peripheral surface is formed at the tip end portion 112*a*.

Figure 12:
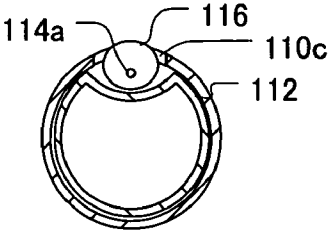
FIG. 12 is a sectional view seen along the line 12—12 in FIG. 10.
Figure 11:
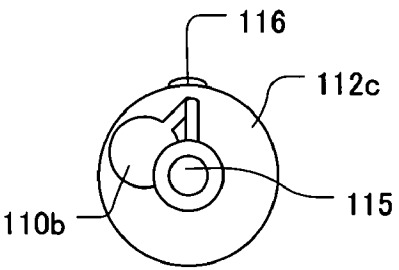
FIG. 11 is a view seen along the line 11—11 in FIG. 10.
Figure 13:
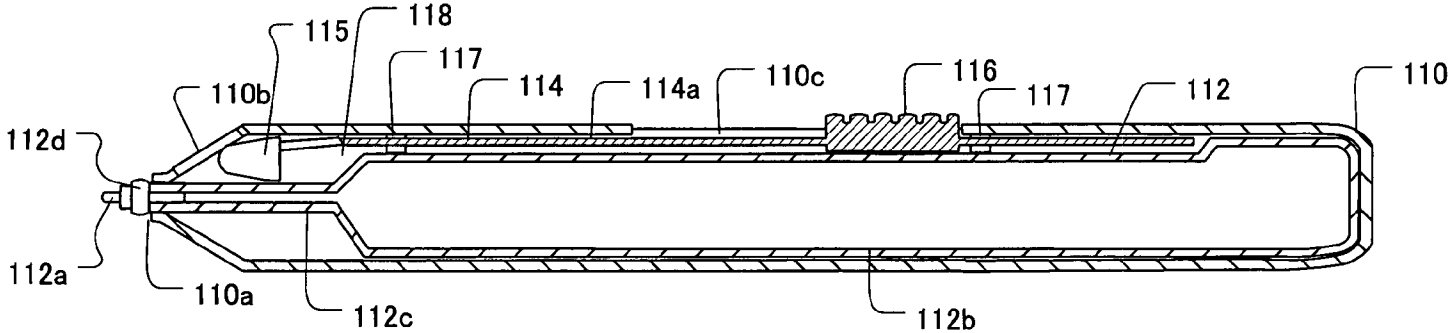
FIG. 13 is a longitudinal sectional view showing a state in which the cap of the instrument in FIG. 10 does not seal the tip end of the medium.

A slide member 114 is placed inside the holder 110 in parallel with the writing medium 112 to be able to advance and retreat, namely, movable in an axial direction. The slide member 114 is mainly constituted of a rod-shaped portion 114*a* as shown in FIG. 12 so as not to occupy a large area in the cross section of the holder 110, and a cap 115 is integrally provided at a front end portion of the rod-shaped portion 114*a*. The cap 115 has a cap shape suitable for covering the tip end portion 112*a* of the writing medium 112.

Guide portions 117 and 117 are formed between the holder 110 and the writing medium 112 to bear the rod-shaped portion 114*a* of the slide member 114 movably in the axial direction of the holder 110 and rotatably on its axis.

An operating member 116 is provided integrally with the slide member 114. The operating member 116 is a side knock member mounted to a side portion of the holder 110 in this example, and is exposed outside from a long hole 110*c* formed on a side peripheral surface of the holder 110, capable of being operated from an outside of the holder 110, and movable in the axial direction in the long hole 110*c*. As shown in FIG. 12, the cross section of the operating member 116 is preferably a circular shape, and a side peripheral surface of the housing portion 112*b* of the writing medium 112 adjacent to the operating member 116 is preferably in an arc shape so as not to interfere with the operating member 116. This makes the operating member 116 rotatable (rotatable on its axis) accompanied with the slide member 114.

A hollow 118 is formed between the holder 110 and the joint portion 112*c* of the writing medium 112, and the cap 115 is capable of being housed in this hollow 118. This hollow 118 communicates with a front end opening 110*b* of the holder 110, and the cap 115 and a front end portion of the slide member 114 are capable of advancing and retreating through the front end opening 110*b*.

FIG. 10 shows a state in which the tip end portion 112*a* of the writing medium 112 is covered and protected with the cap 115. In order to perform writing from this state, the operating member 116 is operated to move with fingers. Thereby, the slide member 114 and the cap 115 advance, and the cap 115 is separated from the tip end portion 112*a* of the writing medium 112. When the operating member 116 is rotated from this state, the cap 115 rotates with the rod-shaped portion 114*a* as the center of rotation, and moves from the position on the same line as the tip end portion 112*a* of the writing medium 112 to the position which is not on the same line. When the operating member 116 is further retreated, the cap 115 passes through the front end opening 110*b* and is housed in the hollow 118. The tip end portion 112*a* of the writing medium 112 is completely released and can be used.

In order to keep the state in which the cap 115 is housed in the hollow 118, the slide member 114 can be always biased rearward by an elastic member. The cap 115 can be housed into the hollow 118 by a biasing force of the elastic member. Alternatively, the cap 115 may be lightly locked inside the hollow 118 instead of the elastic member.

After finishing writing, the tip end portion 112*a* of the writing medium 112 can be covered with the cap 115 by the reverse steps from the above. When the cap 115 is retreating and surrounding the tip end portion 112*a* of the writing medium 112, even if the cap 115 is slightly eccentric from the position of the same line as the tip end portion 112*a* of the writing medium 112, a conical inner peripheral surface of the cap 115 contacts the curved surface portion 112*d* having the curved outer peripheral surface, whereby the position of the cap 115 is automatically adjusted, or even if the cap 115 keeps slightly eccentric, the cap 115 can surely seal the tip end portion 112*a* in the airtight state.

In this way, the sealed state in which the tip end portion 112*a* of the writing medium 112 is protected, and the sealing released state in which the tip end portion 112*a* of the writing medium 112 is released can be switched by only operating the operating member 116.

In the above explanation, the cap 115 is moved by that the operating member 116 is moved not only in the axial direction but also is rotated by an user. Instead of such a rotating operation by the user, a controller can be provided between the slide member 114 and the holder 110 (or the writing medium 112) to move the cap 115 along the specified route.

Figure 14:
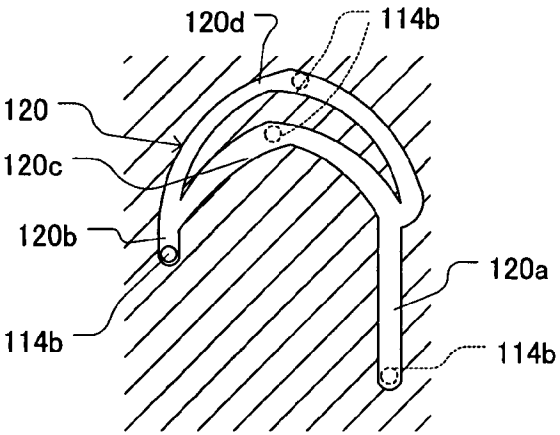
FIG. 14 is a development of an inner peripheral surface of a holder on which a cam surface constructing a controller is formed.

FIG. 14 is a development view of an inner peripheral surface of the holder 110 expressing a cam surface constructing the controller. In the drawing, a cam surface 120 is formed on an inner peripheral surface of the holder 110, and an engaging protruding portion 114*b* provided on the slide member 114 abuts on this cam surface 120 and moves along a cam passage formed by the cam surface 120. The controller is constructed by the cam surface 120 and the engaging protruding portion 114*b*. The cam passage has a first linear passage 120*a* and a second linear passage 120*b* for guiding the slide member 114 in the axial direction, and a first cam passage 120*c* and a second cam passage 120*d* which exist between the first linear passage 120*a* and the second linear passage 120*b* and guides the slide member 114 in the rotational direction.

In the sate in which the cap 115 protects the tip end portion 112*a* of the writing medium 112, the engaging protruding portion 114*b* of the slide member 114 is at a terminal position of the second linear passage 120*b*. When the operating member 116 is operated to advance from this state, the engaging protruding portion 114*b* starts from the second linear passage 120*b* and moves along the second cam passage 120*d*. At this time, the slide member 114 and the cap 115 rotate while advancing. When the operating member 116 is retreated where the engaging protruding portion 114*b* passes the peak of the second cam passage 120*d*, the engaging protruding portion 114*b* is moved to the first linear passage 120*a* from the second cam passage 120*d* and reaches the terminal position of the first linear passage 120*a*. The cap 115 is separated from the tip end portion 112*a* of the writing medium 112 following the movement of the slide member 114, and thereafter, rotates, and moves into the hollow 118. In this way, the tip end portion 112*a* of the writing medium 112 is released from the cap 115 and used for writing.

When the operating member 116 is advanced again from this state, the engaging protruding portion 114*b* of the slide member 114 starts from the terminal position of the first linear passage 120*a* and moves along the first cam passage 120*c*. At this time, the slide member 114 and the cap 115 rotates while advancing. When the operating member 116 is retreated where the engaging protruding portion 114*b* passes the peak of the first cam passage 120*c*, the engaging protruding portion 114*b* is moved to the second linear passage 120*b* from the first cam passage 120*c* and reaches the terminal position of the second linear passage 120*b*. Following the movement of the slide member 114, the cap 115 rotates after separating from the hollow 118, and can cover the tip end portion 112*a* of the writing medium 112.

In this way, the slide member 114 and the cap 115 can be automatically rotated in accordance with the movement in the axial direction of the slide member 114 by the controller constituted of the cam surface 120 and the engaging protruding portion 114*b*.

Figure 15:
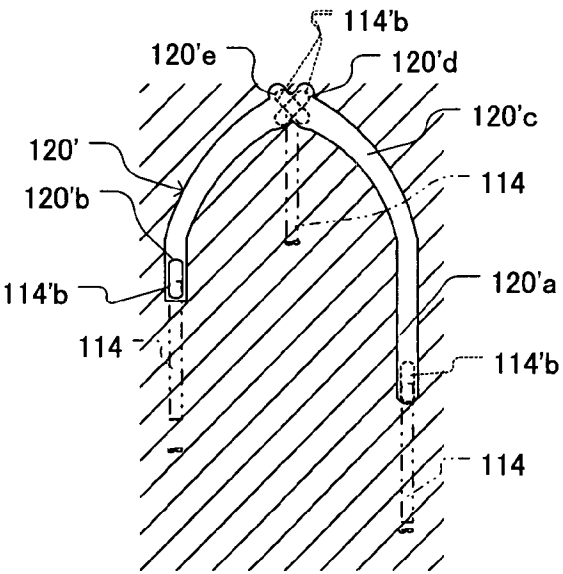
FIG. 15 is a development of an inner peripheral surface of a holder on which a cam surface constructing another example of a controller is formed.

FIG. 15 is a view showing a cam surface 120' and an engaging protruding portion 114'*b* which constructs another example of the controller. The engaging protruding portion 114'*b* is pivotally attached to the slide member 114 via a hinge. A cam passage formed by the cam surface 120' has a first linear passage 120'*a* and a second linear passage 120'*b* which guide the slide member 114 in the axial direction and a cam passage 120'*c* which exists between the first linear passage 120'*a* and the second linear passage 120'*b* and guides the slide member 114 in the rotational direction. The cam passage 120'*c* has two peaks 120'*d* and 120'*e*.

In the state in which the cap 115 protects the tip end portion 112*a* of the writing medium 112, the engaging protruding portion 114'*b* of the slide member 114 is at the terminal position of the second linear passage 120'*b*. When the operating member 116 is operated to advance from this state, the engaging protruding portion 114'*b* starts from the second linear passage 120'*b* and moves to the peak 120'*e*. When the operating member 116 is retreated where the direction of the engaging protruding portion 114'*b* is changed, the engaging protruding portion 114'*b* moves toward the first linear passage 120'*a* to reach the terminal position of the first linear passage 120'*a*. Following the movement of the slide member 114, the cap 115 separates from the tip end portion 112*a* of the writing medium 112, thereafter rotates and moves into the hollow 118. In this way, the tip end portion 112*a* of the writing medium 112 is released from the cap 115 and is used for writing.

When the operating member 116 is advanced again from this state, the engaging protruding portion 114'*b* of the slide member 114 starts from the terminal position of the first linear passage 120'*a* and moves to the peak 120'*d*. When the operating member 116 is retreated where the direction of the engaging protruding portion 114'*b* changes, the engaging protruding portion 114'*b* moves toward the second linear passage 120'*b* and reaches the terminal position of the second linear passage 120'*b*. Following the movement of this slide member 114, the cap 115 separates from the hollow 118, thereafter rotates, and can cover the tip end portion 112*a* of the writing medium 112.

In this way, the slide member 114 and the cap 115 can be automatically rotated in accordance with the movement of the slide member 114 in the axial direction by the controller constituted of the cam surface 120' and the engaging protruding portion 114'*b*.

Figure 18:
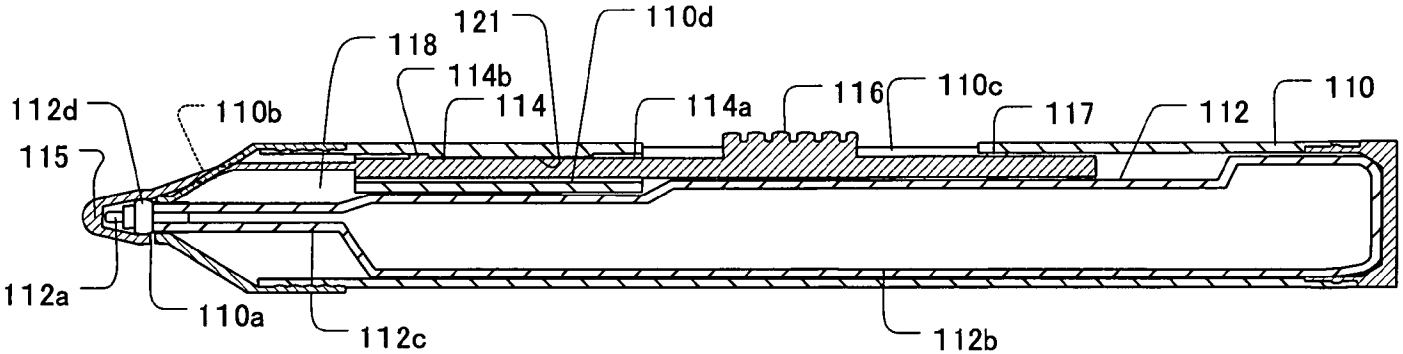
FIG. 18 is a longitudinal sectional view showing an instrument of another example of a controller.
Figure 19:
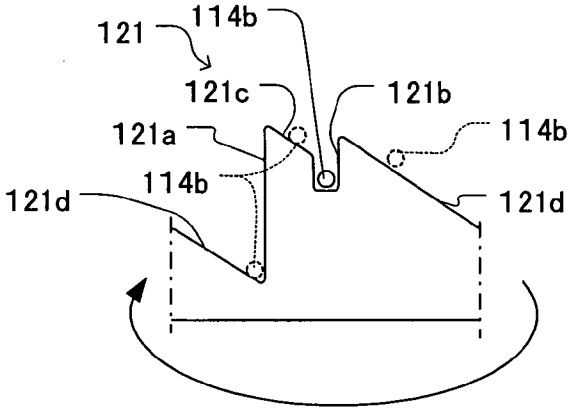
FIG. 19 is a development of an internal cylinder portion of a holder in which a cam surface constructing the controller is formed.

FIG. 18 and FIG. 19 are views showing still another example of the controller. An internal cylinder portion 110*d* is formed inside the holder 110, and the slide member 114 penetrates through the inside of the internal cylinder portion 110*d*. A cam surface 121 is formed around in a circumferential direction on an inner peripheral surface of the internal cylinder portion 110*d*, the engaging protruding portion 114*b* provided on the slide member 114 moves along the cam passage formed by the cam surface 121. The controller is constructed by the cam surface 121 and the engaging protruding portion 114*b*. The cam passage has a first linear passage 121*a* and a second linear passage 121*b* which guide the slide member 114 in the axial direction and a first cam passage 121*c* and a second cam passage 121*d* which exist between the first linear passage 121*a* and the second linear passage 121*b* and guide the slide member 114 in the rotating direction.

In the state in which the cap 115 protects the tip end portion 112*a* of the writing medium 112, the engaging protruding portion 114*b* of the slide member 114 is at the terminal position of the second linear passage 121*b*. When the operating member 116 is operated to advance from this state, the engaging protruding portion 114*b* starts from the second linear passage 121*b*, and advances, and thereafter the engaging protruding portion 114*b* moves along the second cam passage 121*d*. When the operating member 116 is retreated where the engaging protruding portion 114*b* advances to the second cam passage 121*d*, the engaging protruding portion 114*b* moves along the second cam passage 121*d*, and reaches the terminal position of the first linear passage 121*a*. Following the movement of this slide member 114, the cap 115 linearly advances and separates from the tip end portion 112*a* of the writing medium 112, and thereafter rotates and moves into the hollow 118. In this way, the tip end portion 112*a* of the writing medium 112 is released from the cap 115 and is used for writing.

When the operating member 116 is advanced again from this state, the engaging protruding portion 114*b* of the slide member 114 starts from the terminal position of the first linear passage 121*a* and advances, and thereafter moves along the first cam passage 121*c*. When the operating member 116 is retreated where the engaging protruding portion 114*b* advances to the first cam passage 121*c*, the engaging protruding portion 114*b* moves along the first cam passage 121*c*, and the engaging protruding portion 114*b* moves to the second linear passage 121*b* from the first cam passage 121*c* and reaches the terminal position of the second linear passage 121*b*. Following the movement of the slide member 114, the cap 115 linearly advances and separates from the hollow 18, thereafter rotates, further linearly retreats, and can cover the tip end portion 112*a* of the writing medium 112. Though not shown, a flat packing or the like may be attached inside the cap 115 to enhance sealing properties when covering the tip end portion 112*a* of the writing medium 112.

In this way, the slide member 114 and the cap 115 can be automatically rotated in accordance with the movement of the slide member 114 in the axial direction by the controller constituted of the cam surface 121 and the engaging protruding portion 114*b*.

Figure 16:
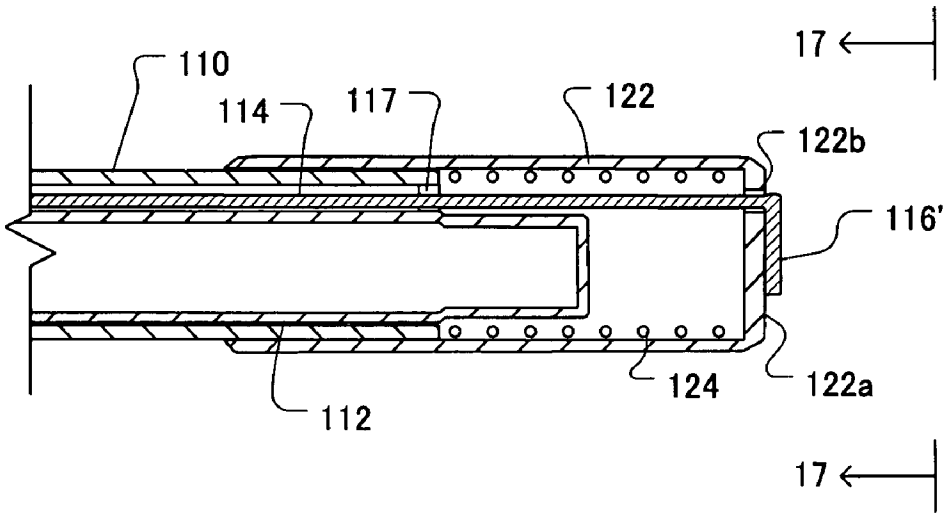
FIG. 16 is a longitudinal sectional view of a rear portion showing an instrument according to a third embodiment of the present invention.
Figure 17:
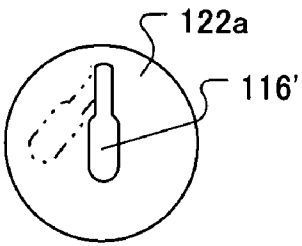
FIG. 17 is a view seen along the line 17—17 in FIG. 16.

FIG. 16 shows still another embodiment. In FIG. 16, a front end portion is not shown since it is the same as in FIG. 10. In this example, an operating member 116' is integrally mounted to a rear end of the slide member 114. A slide cap 122 is fitted onto a rear end of the holder 110, and an elastic member 124 for biasing the slide cap 122 and the holder 110 in the direction to separate from each other is interposed between the slide cap 122 and the holder 110. The operating member 116' penetrates through a through-hole 122*b* formed in a rear end surface 122*a* of the slide cap 122 and engaged with the rear end surface 122*a*. The operating member 116' and the slide member 114 are always biased rearward with respect to the holder 100 by the elastic member 124. After the operating member 116' is pressed forward together with the slide cap 122 and the operating member 116' is swung around the through-hole 122*b*, the force is released, whereby the cap 115 can be moved from the sealed state of the tip end portion 112*a* of the writing medium 112 to the seal released state, or from the seal released state of the tip end portion 112*a* of the writing medium 112 to the sealed state as in the previous embodiment. In both the sealed state and seal released state, the cap 115 is biased rearward, and therefore the tip end portion 112*a* of the writing medium 112 can be reliably sealed in an airtight state, or can reliably housed in the hollow 118.

Figure 20:
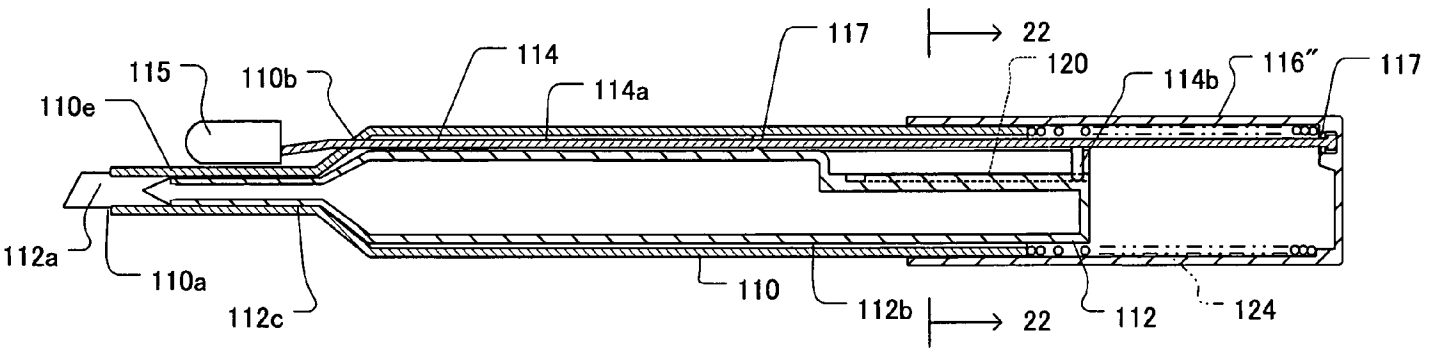
FIG. 20 is a longitudinal sectional view showing an instrument according to a fourth embodiment and shows a state in which the cap dose not seal the tip end of the medium.
Figure 22:
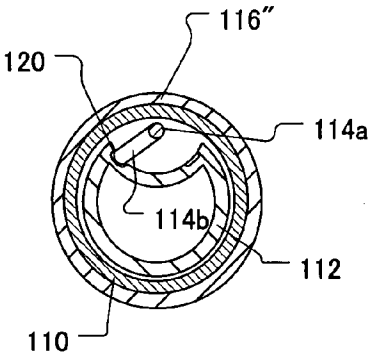
FIG. 22 is a sectional view seen along the line 22—22 in FIG. 20.
Figure 21:
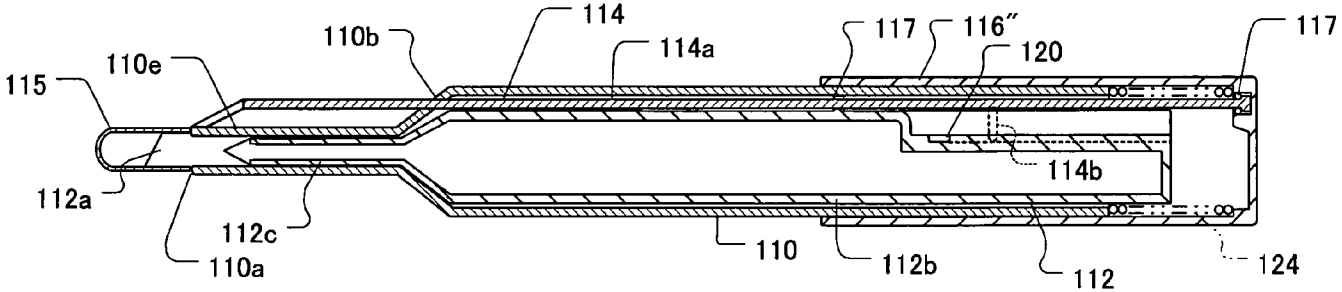
FIG. 21 is a longitudinal sectional view showing an instrument according to a fourth embodiment of the present invention, and shows a state in which the cap seals the tip end of the medium.

FIG. 20 to FIG. 22 show the drawings showing still another embodiment. In this embodiment, the slide cap 122 in the embodiment shown in FIG. 16 becomes an operating member 116", and he operating member 116" becomes a rear end knock member mounted to a rear end portion of the holder 110. The operating member 116" is rotatably connected to the rear end of the slide member 114. An elastic member 124 for biasing the operating member 116" and the holder 110 in the direction to separate both of them from each other is interposed between the operating member 116" and the holder 110. Thus, the operating member 116" and the slide member 114 are always biased rearward with respect to the holder 110 by the elastic member 124.

An engaging protruding portion 114*b* is formed at the slide member 114, while the cam surface 120 is formed on an outer peripheral surface of a rear portion of the housing portion 112*b* of the writing medium 112, and the controller is constructed by the cam surface 120 and the engaging protruding portion 114*b*. This controller can have the same construction as shown in FIG. 14. If the length of the writing medium 112 is short, it is suitable to extend the first linear passage 120*a* to the rear end of the writing medium 112 and open it at a rearmost end, so that when the slide member 114 retreats, the engaging protruding portion 114*b* gets out of the first linear passage 120*a* from the rearmost end of the first linear passage 120*a*, and can move rearward from the writing medium 112. Alternatively, the controller can be one same as the controller shown in FIG. 15 or FIG. 19.

The front end of the slide member 114 protrudes to an outside of the holder 110, and the cap 115 provided at a front end portion of the slide member 114 is not housed in the holder 110 in the seal released state of the tip end portion 112*a* of the writing medium 112, and is disposed beside a reduced diameter portion 110*e* of the tip end portion of the holder 110.

When the force is released after the operating member 116" is pressed forward, the cap 115 can be moved to the seal released state from the sealed state of the tip end portion 112*a* of the writing medium 112, or to the sealed state from the seal released state of the tip end portion 112*a* of the writing medium 112 as in the previous embodiment.

For example, when the operating member 116" is advanced in the state shown in FIG. 20, the engaging protruding portion 114*b* of the slide member 114 moves along the cam passage formed by the cam surface 120 by the controller, and the slide member 114 and the cap 115 advance and rotate, and thereafter retreat. The cap 115 rotates, and thereby moves from the eccentric state beside the writing medium 112 to the concentric position and can cover the tip end portion 112*a* of the writing medium 112 (FIG. 21).

When the operating member 116" is advanced again, by the controller, the engaging protruding portion 114*b* of the slide member 114 moves along the cam passage formed by the cam surface 120, and the slide member 114 and the cap 115 advance and rotate, and thereafter retreat. After the cap 115 rotates and thereby gets out of the tip end portion 112*a* of the writing medium 112, the cap 115 becomes eccentric and returns to the state where the cap 115 is beside the writing medium 112.

In each of the above embodiments, the slide member 114 is rotated by the operation of hand and fingers to the operating member 116, or by the controller 114*b*, 114'*b*, 120, 120' and 121, but the present invention is not limited to this, and when the slide member 114 is constructed by a flexible material, the slide member 114 itself bends and deforms instead of the slide member 114 rotating, and thereby the cap

115 can be rotated between the concentric position with the tip end portion 112*a* of the writing medium 112 and the eccentric position to the tip end portion 112*a* of the writing medium 112.

In some of the above embodiments, the cap 115 and the operating member 116 are formed integrally with the slide member 114, but the present invention is not limited to this, and it is possible to couple the cap 115 or the operating member 116 as a separate component to the slide member 114 by optional coupling means. Connection of the cap 115 or the operating member 116 and the slide member 114 is not limited to integral connection, but may be the connection in the range in which the operating member 116 or the cap 115 can move following the movement of the slide member 114 in the axial direction.

While the invention has been described in terms of several preferred embodiments, those skilled in the art will recognize that the invention can be practiced with modification within the spirit and scope of the appended claims.

What is claimed is:

1. An instrument comprising:

a holder for holding a medium;

a cap capable of covering a tip end portion of the medium;

an operating member provided to be capable of knocking with respect to the holder to attach and detach the cap; and a rotational transform mechanism connecting the cap to the operating member;

wherein the rotational transform mechanism advances the cap in accordance with one knock of the operating member in an axial direction, the rotational transform mechanism then rotates the cap around an axis parallel to the axial direction, and then retreats the cap; and wherein with each knock of the operating member, a state in which the cap covers the tip end portion of the medium and a state in which the cap allows the tip end portion of the medium to be exposed are switchable, and wherein said rotational transform mechanism comprises a knock cam connected to said operating member and unrotatable but movable in the axial direction in a slide axial hole provided in the holder, a cam body provided on an inner peripheral surface of the slide axial hole and having a cam surface facing to a front and inclined in the axial direction, a rotary cam connected to said cap and movable in the axial direction with respect to the slide axial hole inside the slide axial hole, and an elastic member for biasing the rotary cam rearward, wherein the knock cam has a cam surface facing to the front and inclined in the axial direction, and rotation of the rotary cam is guided by the cam surfaces of the knock cam and the cam body.

2. The instrument according to claim 1, wherein the cap rotates 180 degrees in accordance with one knock operation of said operating member.

3. The instrument according to claim 1, wherein the holder is provided with a hollow portion, which houses at least a part of cap in a state in which the cap allows the tip end portion of the medium to be exposed, at a tip end portion of said holder.

4. The instrument according to claim 1, wherein a curved surface portion is provided on the tip end portion of the medium to keep sealing properties between the tip end portion and the cap.

5. An instrument including:

a holder for holding a medium;

a tip end portion of which is protruded forward from the holder;

a slide member provided in the holder to be movable in an axial direction;

a cap connected to a tip end portion of the slide member so as to cover a tip end portion of the medium;

an operating portion connected to the slide member and movable in the axial direction so as to be operated from an outside of the holder; and a controller which actuates the slide member, and the cap is rotated around an axis parallel to the axial direction and retracted in accordance with the movement in the axial direction of the slide member, said controller being provided between one of the holder and the medium and the slide member, wherein said controller includes a rotational transform mechanism which comprises a knock cam connected to said operating member and unrotatable but movable in the axial direction in a slide axial hole provided in the holder, a cam body provided on an inner peripheral surface of the slide axial hole and having a cam surface facing to a front and inclined in the axial direction, a rotary cam connected to said cap and movable in the axial direction with respect to the slide axial hole inside the slide axial hole, and an elastic member for biasing the rotary cam rearward, wherein the knock cam has a cam surface facing to the front and inclined in the axial direction, and rotation of the rotary cam is guided by the cam surfaces of the knock cam and the cam body.

6. The instrument according to claim 5, wherein a hollow portion for housing said cap is provided in the vicinity of a tip end portion of the holder.

7. The instrument according to claim 5, further including the elastic member for biasing the slide member rearward with respect to the holder.

8. The instrument according to claim 5, wherein said controller comprises a cam surface provided on the holder, and the engaging protruding portion provided on the slide member to work in cooperation with the cam surface.

9. The instrument according to claim 5, wherein the operating portion includes a side knock member mounted to a side portion of the holder.

10. The instrument according to claim 5, wherein said operating portion includes a rear end knock member mounted to a rear end portion of the holder.

* * * * *